US006928701B2

(12) United States Patent
Hutter, III

(10) Patent No.: US 6,928,701 B2
(45) Date of Patent: Aug. 16, 2005

(54) CABLE TIE

(75) Inventor: Charles G. Hutter, III, Carson City, NV (US)

(73) Assignee: Physical Systems, Inc., Carson City, NV (US)

( * ) Notice: Subject to any disclaimer, the term of this patent is extended or adjusted under 35 U.S.C. 154(b) by 0 days.

(21) Appl. No.: 10/840,918

(22) Filed: May 6, 2004

(65) Prior Publication Data

US 2004/0231110 A1 Nov. 25, 2004

Related U.S. Application Data

(60) Provisional application No. 60/472,981, filed on May 22, 2003.

(51) Int. Cl.[7] ..... B65D 63/00
(52) U.S. Cl. ..... 24/16 PB
(58) Field of Search ..... 27/16 PB, 16 R, 27/17 A, 17 AP, 30.5 R; 248/74.1–74.3; 292/318, 321

(56) References Cited

U.S. PATENT DOCUMENTS 3,875,618 A * 4/1975 Schuplin ..... 24/16 PB
4,422,217 A * 12/1983 Barrette ..... 24/16 PB
4,498,507 A * 2/1985 Thompson ..... 24/16 PB
4,862,561 A * 9/1989 Lichtenberg ..... 24/16 PB
4,993,669 A * 2/1991 Dyer ..... 24/16 PB
5,121,524 A * 6/1992 Mortensen ..... 24/16 PB
5,193,251 A * 3/1993 Fortsch ..... 24/16 PB
5,224,244 A * 7/1993 Ikeda et al. ..... 24/16 PB
5,479,797 A * 1/1996 Peterson ..... 24/16 PB
5,544,391 A * 8/1996 Hoffman ..... 24/16 PB
6,049,949 A * 4/2000 Guthke ..... 24/16 PB
6,128,809 A * 10/2000 Khokhar ..... 24/30.5 P
6,484,367 B1 11/2002 Caveney et al.
6,532,631 B2 * 3/2003 Rohaly et al. ..... 24/16 PB

* cited by examiner

*Primary Examiner*—Robert J. Sandy
*Assistant Examiner*—Ruth C. Rodriguez
(74) *Attorney, Agent, or Firm*—Kelly Lowry & Kelley, LLP

(57) ABSTRACT

An improved cable tie is provided for securely bundling one or more wires or the like. The cable tie includes a buckle formed by a buckle housing having a double-ended barbed insert mounted therein. The buckle housing defines an anchor slot open at one end for seated reception of a first end of a flexible cable strap, with the barbed insert gripping and retaining the strap therein. A through channel is also formed in the buckle housing and accommodates unidirectional slide-through passage of an opposite or free end of the strap, with the barbed insert gripping and retaining the strap free end against withdrawal relative to the through channel. This flexible strap can be formed from a high strength material such as polyetheretherketone (PEEK) suitable for use in a relatively high temperature environment.

22 Claims, 4 Drawing Sheets

CABLE TIE

This application claims the benefit of U.S. Provisional Application No. 60/472,981, filed May 22, 2003.

BACKGROUND OF THE INVENTION

This invention relates generally to cable or wire tie strap devices for securely wrapping and retaining one or more elongated components such as conductive wires or cables or the like in a relatively neat and confined bundle. More particularly, this invention relates to an improved cable tie including a buckle designed for quick and easy assembly with a flexible strap of selected length, and further wherein the strap can be formed from a plastic material or the like chosen for compatibility with use in a relatively high temperature environment.

Cable or wire tie strap devices are generally known in the art, and typically comprise a molded plastic construction including an elongated strap component formed integrally at one end thereof with a buckle component. An opposite or free end of the elongated strap has a cross sectional size and shape for sliding reception through an open channel formed in the buckle, with a toothed pawl or the like within the buckle engaging a succession of serrated ratchet teeth formed along the length of the strap to accommodate one-way or unidirectional displacement while preventing strap withdrawal through the buckle channel. With this construction, the free end of the strap can be wrapped about one or more elongated components such as a plurality of conductive wires or the like, and then drawn through the buckle with a selected tension force for securely retaining the wires in a compact bundle.

In some environments of use, such as an aerospace or aircraft application, the cable tie can be subjected to elevated temperatures sufficient to adversely affect the structural integrity of the cable tie by softening and/or partially melting the molded plastic material. More particularly, cable ties are commonly formed by injection molding of a thermoplastic material such as nylon plastic, but such materials tend to lose structural integrity and become somewhat rubbery or melt when exposed to elevated temperatures on the order of about 400–450° F., as may be encountered in a variety of aircraft and/or aerospace applications. When this occurs, the molded teeth formed on the flexible strap and/or the pawl formed on the buckle can lose strength resulting in undesirable loosening and/or potential failure of the cable tie. Attempts to form the cable tie from alternative plastic materials having improved structural properties at elevated temperatures generally have not been successful, due in part to difficulties in molding such materials to include the requisite surface details such as the pawl and teeth.

There exists, therefore, a significant need for further improvements in and to cable tie devices, particularly with respect to providing a cable tie suitable for use in an elevated temperature environment. The present invention fulfills this need and provides further related advantages.

SUMMARY OF THE INVENTION

In accordance with the invention, an improved cable tie adapted for use in a relatively high temperature environment is provided for securely wrapping and retaining one or more elongated components such as conductive wires or cables or the like in a relatively neat and compact confined bundle. The improved cable tie comprises a buckle defining an open-ended anchor slot for quick and easy seated and locked reception of a first end of an elongated flexible strap, and a through channel for unidirectional slide-through passage of an opposite or free end of the strap. With this construction, the strap can be formed from a material selected for compatibility with a relatively high temperature environment. If desired, the strap can be assembled with the buckle in the field at the site of use immediately prior to wrapped installation about a bundle of wires or the like.

In a preferred form, the buckle comprises a buckle housing constructed from a molded plastic material such as polyetheretherketone (PEEK) or polyetherimide (PEI) to define the anchor slot open at one end and the through channel. A double-ended barbed insert is mounted within the buckle housing. One end of the barbed insert includes a first barb defining at least one tooth extending partially into the anchor slot and directionally oriented to permit push-fit reception of the first end of the flexible strap, while engaging and retaining said strap first end to prevent withdrawal thereof from the anchor slot. In a similar manner, the second or opposite end of the barbed insert includes a second barb defining at least one tooth extending partially into the through channel and directionally oriented to permit slide-through passage of the opposite or free end of the flexible strap, while engaging and retaining the strap free end against reverse displacement relative to the through channel. The strap free end can thus be pulled through the channel and selectively tensioned to wrap the strap tightly about a bundle of wires or the like.

With this construction, the flexible strap can be formed from a material compatible for use in a relatively high temperature environment, substantially without undesired loosening or potential failure when exposed to relatively high temperatures. In the preferred form, the flexible strap is constructed from an extruded material such as polyetheretherketone (PEEK) which can be extruded in an amorphous state and then heat treated to a relatively stiffer and more crystalline form providing a high strength strap material suitable for use in relatively high temperature applications such as aircraft and aerospace environments subjected to relatively high temperatures on the order of about 500° F. and higher. In addition, the barbed insert can also be formed from a material having high structural integrity in a relatively high temperature environment, such as stamped spring steel sheet stock or the like, The flexible strap can be cut into individual lengths for assembly with individual buckles, and thereafter shipped in assembled state to a site of use. In this configuration, subsequent to installation of each assembled cable tie in wrapped relation about a bundle of wires or the like, any excess portion of the flexible strap extending beyond the buckle can be trimmed off and discarded. In an alternative arrangement, the flexible strap can be provided in an elongated length carried on a spool or the like for shipment with a plurality of buckles unassembled therewith to a site of use. Prior to installation, a selected length of the strap can be severed from the spool and assembled in-the-field with a buckle, and then installed in wrapped relation about a bundle of wires or the like.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a side elevation view illustrating a cable tie constructed in accordance with the present invention installed in wrapped relation about a bundle of conductive wires or cables or the like;

DETAILED DESCRIPTION OF THE PREFERRED EMBODIMENT

Figure 1:
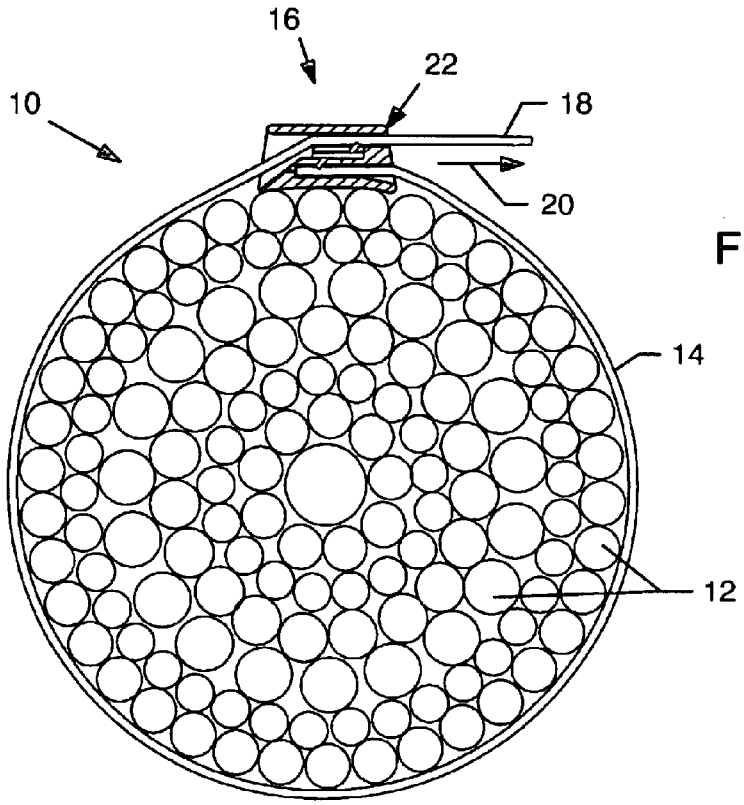

As shown in the exemplary drawings, an improved cable tie referred to generally by the reference numeral 10 is provided for securely wrapping and retaining one or more elongated articles such as a plurality of conductive wires or cables 12 (FIG. 1) in a compact and confined bundle. The improved cable tie 10 comprises an elongated flexible strap 14 assembled with a buckle 16, wherein the strap 14 advantageously can be constructed from a material having relatively high tensile strength and high creep strength particularly when subjected to a relatively high temperature environment.

Figure 2:
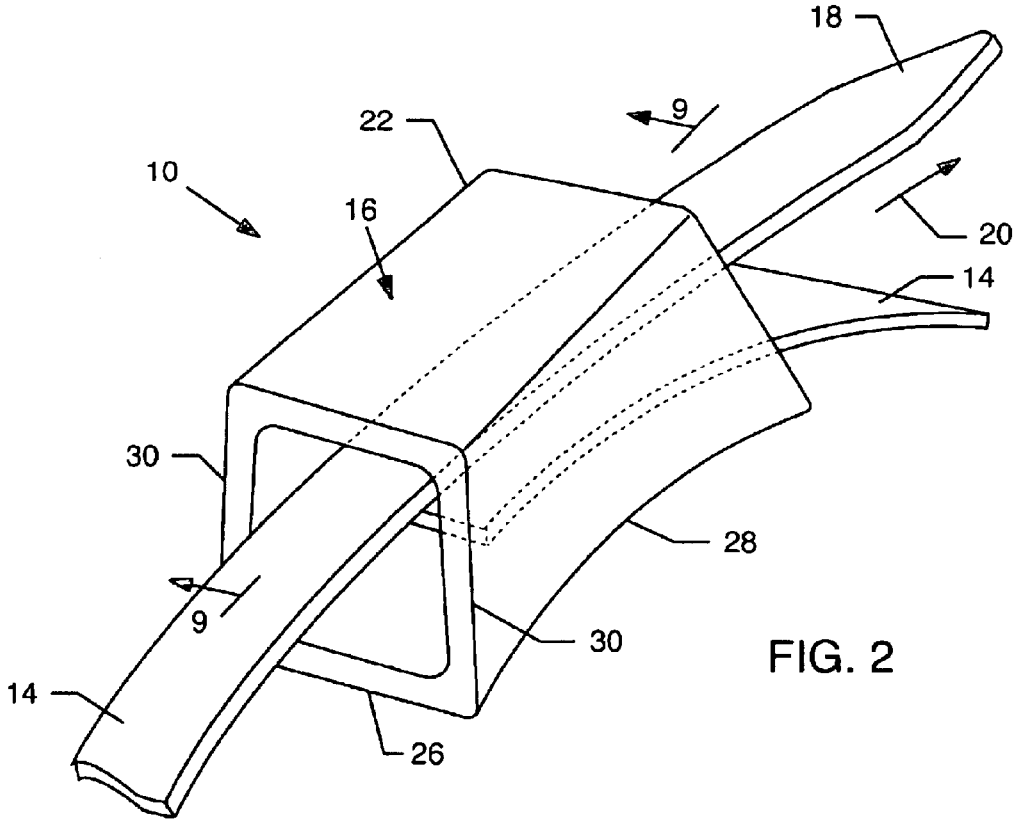
FIG. 2 is an enlarged and fragmented perspective view showing the cable tie of FIG. 1.
Figure 3:
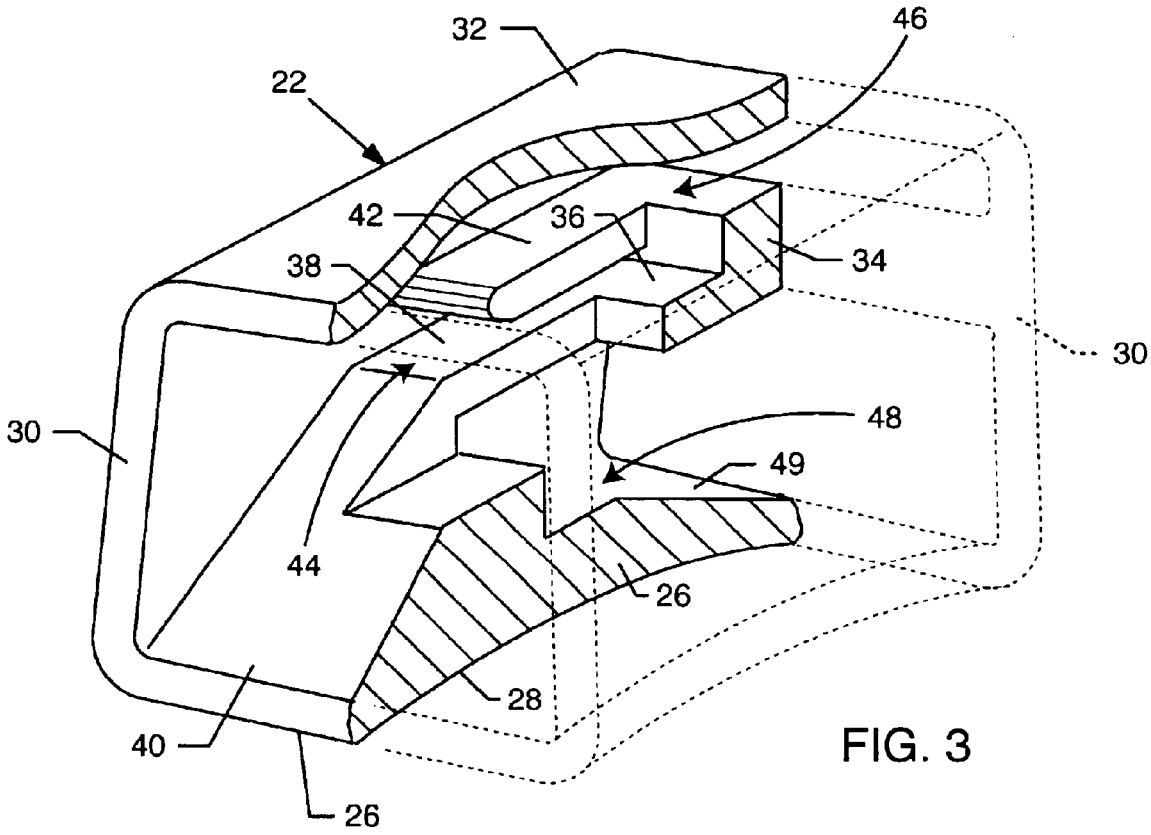
FIG. 3 is an enlarged perspective view showing a buckle housing for use in the cable tie of FIGS. 1 and 2, with portions of the buckle housing broken away to illustrate internal construction details thereof.

The illustrative cable tie 10 is particularly designed for use in an aircraft or aerospace application or the like for retaining the plurality of wires 12 or the like in a relatively neat and orderly bundle. In this regard, the buckle 16 is designed for quick and easy connection to a first end of the flexible strap 14, for securely retaining the strap 14 as it is wrapped under selected tension about the bundle or wires 12 or the like. The buckle 16 further accommodates slide-through unidirectional passage of an opposite or free end 18 of the strap 14, substantially without permitting or allowing any significant reverse motion of the strap free end back through the buckle. Importantly, the buckle 16 thus engages and retains the strap 14 in a closed loop configuration wrapped about the wire bundle. The free end 18 of the strap 14 protruding through and beyond the buckle 16 can be drawn manually or with a selected tensioning tool (not shown) in the direction of arrow 20 as viewed in FIGS. 1 and 2 for constricting the strap 14 tightly with a selected tension force wrapped securely about the wire bundle.

In accordance with primary features of the present invention, the strap 14 and buckle 16 are formed as separate components thereby permitting use of a strap material such as an extruded plastic that may be otherwise incompatible with traditional cable tie plastic injection molding techniques and processes. That is, the strap 14 can be constructed from an extrudable or extruded material such as a plastic having physical properties suitable for use in particular environmental conditions, such as a relatively high temperature environment, with one preferred strap material comprising polyetheretherketone (PEEK) extruded in a substantially amorphous state and then heat treated to a more crystalline form exhibiting high tensile and high creep strength in combination with structural integrity at relatively high temperatures on the order of up to about 500° F. and higher. This high strength flexible strap 14 can be assembled with the buckle 16 which comprises a buckle housing 22 that can be formed as by injection molding from a relatively low cost plastic material such as PEEK or polyetherimide (PEI). This buckle housing 22 is configured for receiving and supporting a barbed insert 24 (FIG. 4) for engaging and retaining the strap 14, wherein the barbed insert 24 is also constructed from a material having relatively high structural integrity at elevated temperatures. One preferred material for the barbed insert 24 comprises a metal strip such as stainless steel spring sheet stock which can be formed as by stamping to the desired size and configuration.

The buckle housing 22 is shown in more detail in FIGS. 3 and 5–9. As shown, the buckle housing 22 has a generally block-like shape defining a base wall 26 having an outboard or underside face 28 which may be concavely contoured for relatively close-fit engagement with the contained wire bundle (FIG. 1), thereby minimizing or eliminating undesired free space within the closed loop defined by the assembled strap 14 and buckle 16. A pair of opposed side walls 30 upstand from the opposite sides of the base wall 26, and the upper ends of these side walls 30 are joined to an upper wall 32. The base wall 26 cooperates with the pair of side walls 30 and the upper wall 32 to define an open-ended buckle housing structure for assembly with the strap 14, as will be described in more detail.

The interior of the open-ended buckle housing 22 is subdivided by internal surfaces for assembly with the barbed insert 24, and also for assembly with the strap 14. In this regard, FIGS. 3 and 5–9 show the buckle housing 22 to incorporate a centrally positioned cross brace 34 extending transversely across the housing interior generally at a front end thereof. This central cross brace 34 is joined at a rear side thereof to a relatively short platform segment 36 also extending transversely across the housing interior. The opposite ends of this platform segment 36 are joined in turn to a respective pair of rearwardly extending lower shelf segments 38 which extend along the inboard faces of the side walls 30, and then merge with a downwardly and rearwardly extending rear guide ramp 40 terminating generally at a rear end or rear margin of the base wall 26.

A laterally spaced pair of upper shelf segments 42 also extend rearwardly from an upper margin of the central cross brace 34, along the inboard faces of the side walls 30, in spaced relation above the lower shelf segments 38. These upper shelf segments 42 thus cooperate with the lower shelf segments 38 to define a rearwardly open pocket 44 for receiving and supporting the barbed insert 24, as will be described. These upper shelf segments 42 have rear ends or margins terminating generally at a position spaced above a forward margin of the underlying rear ramp 40. In addition, the upper shelf segments 42 are spaced below an inboard or lower face of the outboard wall 32 and thus cooperate therewith to define a through channel 46 extending continuously between the rear and front ends of the buckle housing 22.

The rearwardly open pocket 44 for receiving and supporting the barbed insert 24 is spaced above and cooperates with the lower shelf segments 38 and the base wall 26 to define a forwardly open anchor slot 48. As shown best in FIG. 3, the inboard face of the base wall 26 may be contoured to include an inclined front ramp 49 guiding or leading upwardly and rearwardly from a forward margin of the base wall 26 and defining a forward region of the anchor slot 48.

Figure 4:
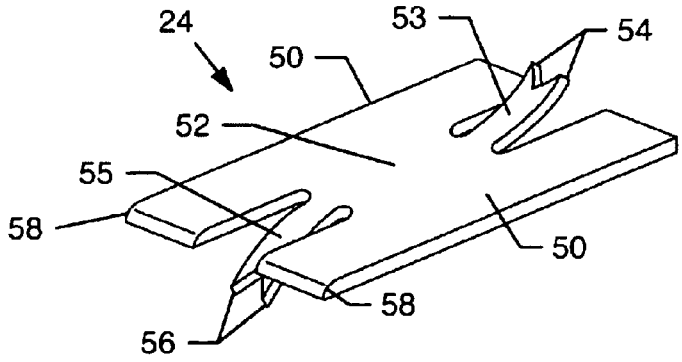
FIG. 4 is a perspective view of a barbed insert for mounting into the buckle housing of FIG. 3.

The barbed insert 24 is illustrated in one preferred form in FIG. 4, to comprise a unitary metal component which can be formed economically from stamped metal spring steel sheet stock or the like. As shown, the barbed insert 24 includes a pair of elongated, generally parallel side rails 50 at opposite sides of a central segment 52 which is stamped and cut as by die cutting or the like to define an upwardly angled barb 53 having one or more upwardly and forwardly extending teeth 54, and a downwardly angled barb 55 having one or more downwardly and rearwardly angled teeth 56. Alternatively, persons skilled in the art will recognize and appreciate that the barbed insert 24 can be constructed from other materials such as plastic materials or the like suitable compatible with the particular intended environment of use.

Figure 5:
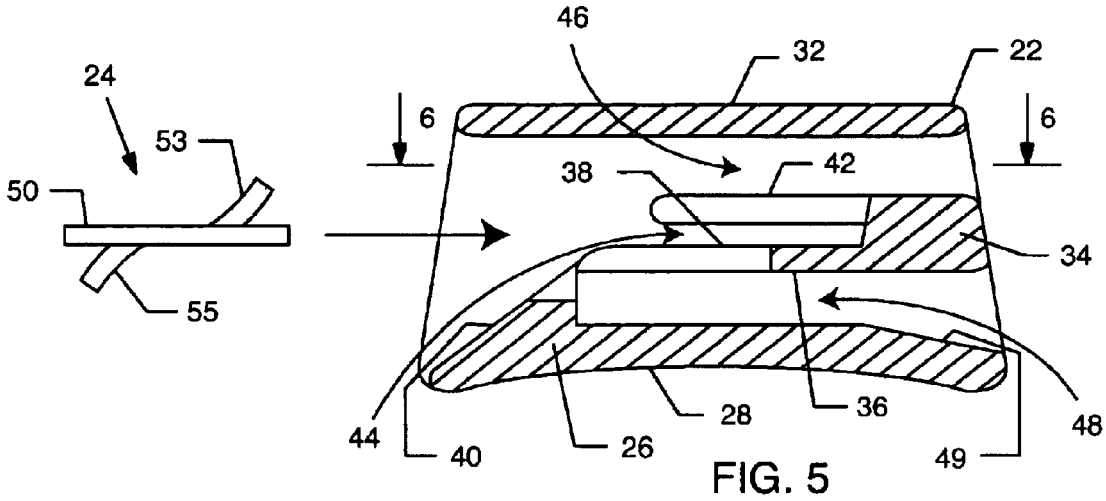
FIG. 5 is an exploded sectional view depicting mounting of the barbed insert of FIG. 4 into the buckle housing to form an assembled buckle.
Figure 6:
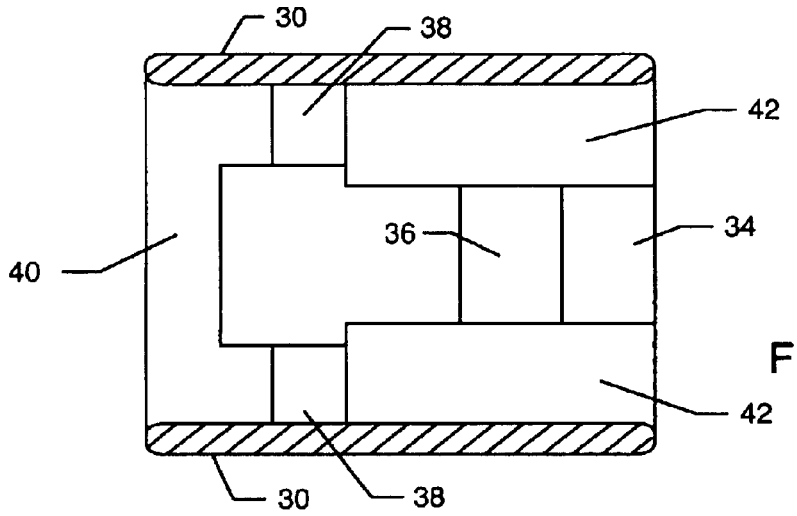
FIG. 6 is a horizontal sectional view taken generally on the line 6—6 of FIG. 5.
Figure 7:
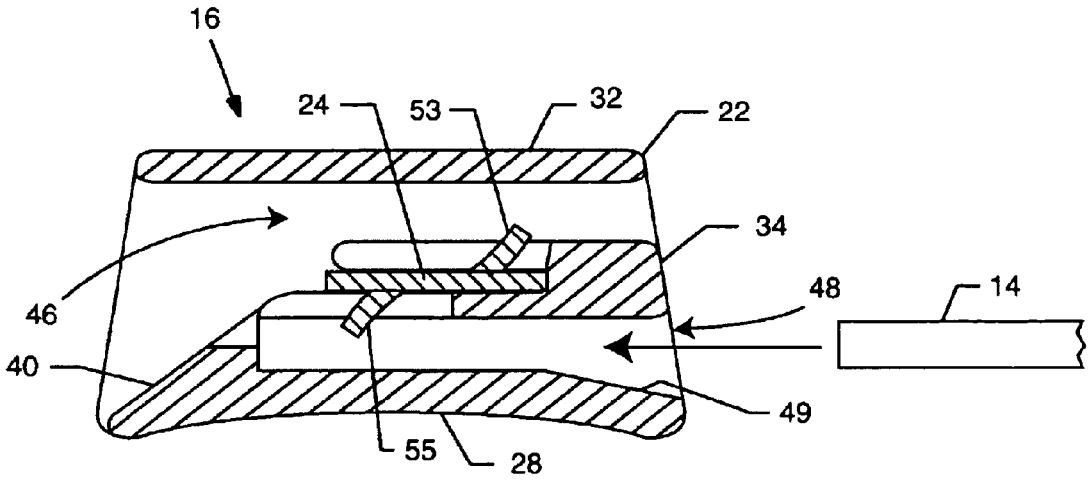
FIG. 7 is an exploded sectional view similar to FIG. 5, but showing seated reception of a first end of a flexible strap into an open-ended anchor slot defined by the buckle housing.
Figure 8:
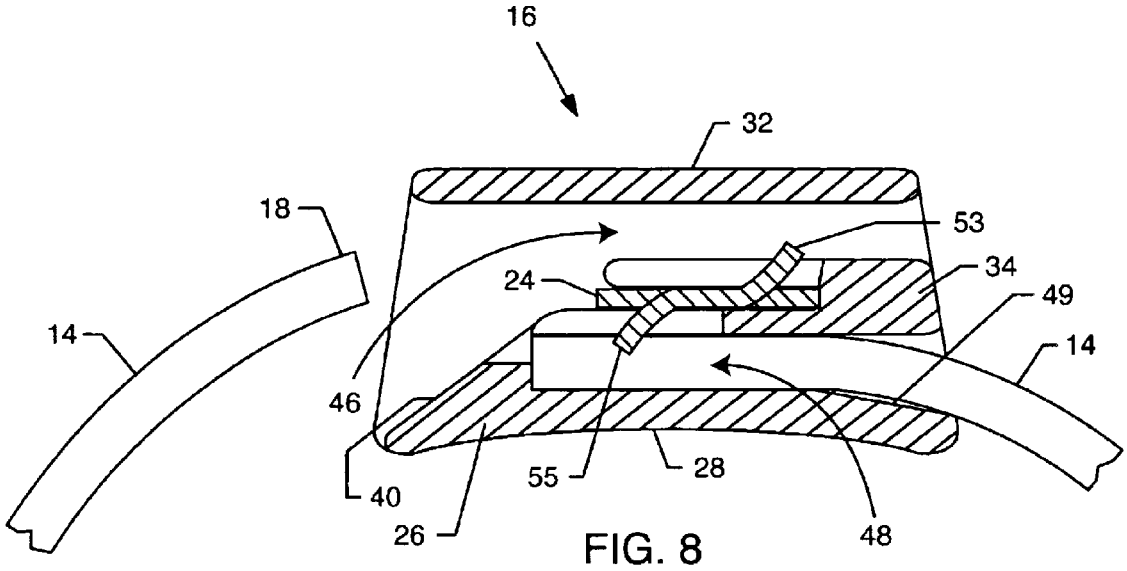
FIG. 8 is an exploded sectional view similar to FIG. 7, but illustrating slide-through reception of an opposite or free end of the flexible strap through a through channel defined by the buckle housing.
Figure 9:
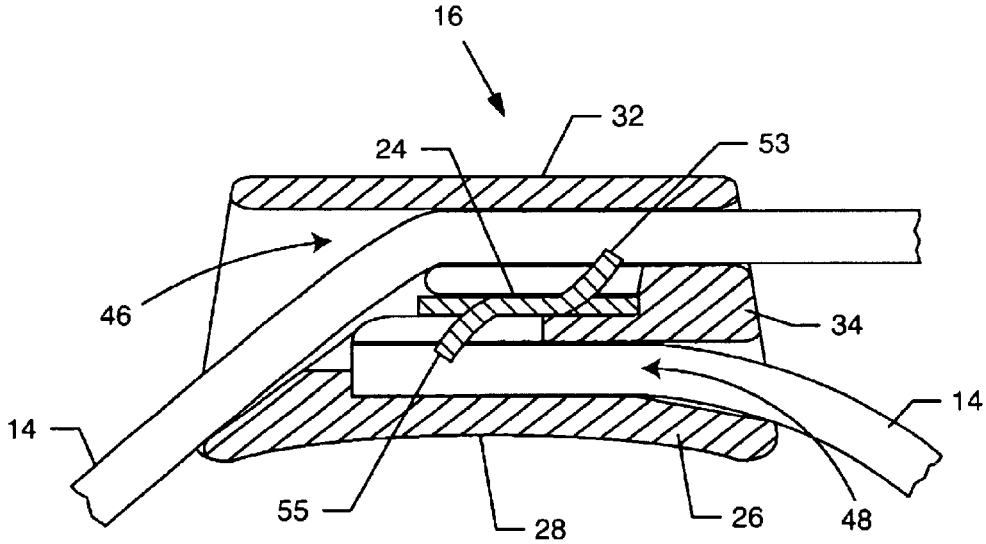
FIG. 9 is a sectional view similar to FIG. 8, taken generally on the line 9—9 of FIG. 2.

FIGS. 5 and 7 illustrate installation of the barbed insert 24 into the rearwardly open pocket 44, with the side rails 50 of the barbed insert 24 retained between the lower and upper shelf segments 38 and 42 adjacent the side walls 30. In this arrangement, the central segment 52 of the barbed insert 24 is disposed within the laterally open space between the pairs of shelf segments 38, 42, so that the upwardly angled barb 53 and the teeth 54 thereon project upwardly and forwardly a short distance into the through channel 46 whereas the downwardly angled barb 55 and the teeth 56 thereon project downwardly and rearwardly a short distance into the anchor slot 48.

With the barbed insert 24 mounted within the buckle housing 22 to form the assembled buckle 16, the first end of the flexible strap 14 can be securely seated and locked within the forwardly open anchor slot 48. In this regard, this connection is achieved by slide-fit reception of the strap first end rearwardly into the anchor slot 48, as viewed in FIGS. 7–8. The teeth 56 on the downwardly angled barb 55 are rearwardly angled to permit slide-fit one-way reception of the strap first end, but bind and engage with the strap 14 to positively lock the strap end against withdrawal or retraction from the anchor slot 48. Undesirable rearward displacement of the barbed insert 24 within the buckle housing 22 during insertion of the strap first end into the anchor slot 48 can be prevented by suitably holding the barbed insert in place with a fixture tool (not shown) or the like, or alternately by slight flaring or splaying the rearward edges or corners of the side rails 50 (as indicated by reference numeral 58 in FIG. 4) so that these rearward corners may engage the inboard faces of the side walls 30 of the buckle housing 22 to prevent rearward displacement relative to the side walls 30.

Thereafter, the flexible strap 14 can be wrapped about the bundle or wires 12 or other elongated components, and the free end 18 of the strap can then be unidirectionally passed through the open channel 46 formed in the buckle 16. In this regard, the rear ramp 40 guides the free end 18 of the strap upwardly for slide-fit passage into and through the through channel 46. The free end 18 of the strap 14 may be cut to a pointed shape as shown (FIG. 2) to facilitate such insertion into and through the channel 46. Importantly, the teeth 54 on the upwardly angled barb 53 are forwardly angled to accommodate relatively free forward sliding movement of the strap 14 through the channel 46. However, these teeth 54 bind and engage with the strap 14 to positively lock the strap end against rearward withdrawal or retraction relative to the channel 46. The strap 14 can thus be drawn manually or with a suitable tensioning tool (not shown) through the channel 46 into a compact closed loop wrapped tightly and securely about the bundle to be contained.

The flexible strap 14 can be cut into individual lengths for assembly with individuals buckles 16 at a production facility, and thereafter shipped in assembled state to a site of use. In this configuration, subsequent to installation of each assembled cable tie 10 with the strap 14 in wrapped relation about a bundle 12 of wires or the like, any excess portion of the flexible strap including the pointed free end 18 extending beyond the buckle 16 can be trimmed off and discarded. In an alternative arrangement, the flexible strap 18 can be provided in an elongated length carried on a spool (not shown) or the like for shipment to a site of use in unassembled form, together with a plurality of buckles 16 each including the barbed insert 24 installed within the associated buckle housing 22. In this form, prior to installation, a selected length of the strap 18 can be drawn from the spool and assembled in-the-field with a buckle 16. Then, a selected length of the strap 14 can be severed from the spool, and installed in wrapped relation about a bundle 12 of wires or the like. Such in-the-field assembly of the strap 14 and buckle 16 beneficially accommodates use of custom-cut and custom-fitted lengths of the strap 14, so that any excess portion trimmed subsequent to installation is minimized.

A variety of further modifications and improvements in and to the improved cable tie of the present invention will be apparent to those persons skilled in the art. Accordingly, no limitation on the invention is intended by way of the foregoing description and accompanying drawings, except as set forth in the appended claims.

What is claimed is:

1. A cable tie, comprising:

an elongated flexible strap having first and second opposite ends; and a buckle including a buckle housing defining an anchor slot open at one end for seated reception of said strap first end and a through channel for slide-through passage of said strap second end, a first barb within said anchor slot for gripping and retaining said strap first end within said anchor slot, and a second barb within said through channel for permitting unidirectional slide-through passage of said strap second end while gripping and retaining said strap second end to prevent withdrawal relative to said through channel;

said anchor slot in said buckle housing opening in a forward direction, said first barb extending into said anchor slot in a rearward direction, and said second barb extending into said through passage in a forward direction, further including a barbed insert having said first and second barbs formed thereon, said buckle housing defining a pocket for receiving and supporting said barbed insert.

2. The cable tie of claim 1 wherein said pocket is formed generally between said anchor slot and said through channel.

3. The cable tie of claim 1 wherein said barbed insert is formed from spring steel.

4. The cable tie of claim 1 wherein said barbed insert is formed from a metal stamping.

5. The cable tie of claim 1 wherein said barbed insert includes at least one flared edge for engaging said buckle housing to retain said barbed insert within said pocket.

6. The cable tie of claim 1 wherein said flexible strap is formed from an extruded plastic material.

7. The cable tie of claim 1 wherein said flexible strap is formed from a high temperature plastic material.

8. The cable tie of claim 7 wherein said flexible strap is formed from extruded polyetheretherketone.

9. The cable tie of claim 1 wherein said buckle housing comprises a unitary plastic molding.

10. The cable tie of claim 1 wherein said buckle housing further defines a guide ramp at said open end of said anchor slot.

11. The cable tie of claim 1 wherein said buckle housing further defines a guide ramp at an entrance end of said through channel.

12. The cable tie of claim 1 wherein said buckle housing defines an underside face of generally concave shape.

13. A cable tie, comprising:

an elongated flexible strap having first and second opposite ends; and a buckle assembly including a buckle housing defining a forwardly open anchor slot open for seated reception of said strap first end, a through channel for slide-through passage of said strap second end, and a rearwardly open pocket formed generally between said anchor slot and said through channel;

said buckle assembly further including a barbed insert having a size and shape for seated reception into said pocket, said barbed insert including a first barb angling generally rearwardly within said anchor slot for gripping and retaining said strap first end within said anchor slot, and a second barb angling generally forwardly within said through channel for permitting unidirectional slide-through passage of said strap second end while gripping and retaining said strap second end to prevent withdrawal relative to said through channel.

14. The cable tie of claim 13 wherein said barbed insert is formed from spring steel.

15. The cable tie of claim 13 wherein said barbed insert is formed from a metal stamping.

16. The cable tie of claim 13 wherein said barbed insert includes at least one flared rear edge for engaging said buckle housing to retain said barbed insert within said pocket.

17. The cable tie of claim 13 wherein said flexible strap is formed from an extruded plastic material.

18. The cable tie of claim 13 wherein said flexible strap is formed from a high temperature plastic material.

19. The cable tie of claim 18 wherein said flexible strap is formed from extruded polyetheretherketone.

20. The cable tie of claim 13 wherein said buckle housing comprises a unitary plastic molding.

21. The cable tie of claim 13 wherein said buckle housing further defines a guide ramp at a forward end of said anchor slot.

22. The cable tie of claim 13 wherein said buckle housing further defines a guide ramp at a rearward end of said through channel.

* * * * *